US007828197B2

(12) United States Patent
Schuetz

(10) Patent No.: US 7,828,197 B2
(45) Date of Patent: Nov. 9, 2010

(54) COMPOSITE CONTAINERS AND METHODS FOR SEALING THE SAME

(75) Inventor: Jeffrey M. Schuetz, Florence, SC (US)

(73) Assignee: Sonoco Development, Inc., Hartsville, SC (US)

( * ) Notice: Subject to any disclaimer, the term of this patent is extended or adjusted under 35 U.S.C. 154(b) by 972 days.

(21) Appl. No.: 11/332,752

(22) Filed: Jan. 13, 2006

(65) Prior Publication Data

US 2007/0164095 A1 Jul. 19, 2007

(51) Int. Cl.
*B65D 43/02* (2006.01)

(52) U.S. Cl. ..... 229/123.1; 229/125.05; 229/121

(58) Field of Classification Search ..... 229/125.05, 229/245, 121, 123.1; 220/256.1; 53/128.1, 53/129.1, 138.1, 541, 242, 286
See application file for complete search history.

(56) References Cited

U.S. PATENT DOCUMENTS 3,767,076 A 10/1973 Kennedy
3,934,749 A * 1/1976 Andrulionis ..... 220/256.1
3,973,719 A * 8/1976 Johnson et al. ..... 229/5.6
4,264,316 A 4/1981 Knudsen
4,697,719 A * 10/1987 Allen ..... 220/258.2
4,890,759 A * 1/1990 Scanga et al. ..... 220/273
5,105,964 A 4/1992 Heath
5,145,065 A 9/1992 Mizutani et al.
5,188,253 A 2/1993 Poore et al.
5,258,086 A * 11/1993 Hale ..... 156/190
5,775,531 A 7/1998 Lowry
6,092,717 A * 7/2000 Lowry ..... 229/120.03
6,165,115 A * 12/2000 Rea ..... 493/109
6,270,004 B1 8/2001 Drummond et al.
6,955,028 B1 * 10/2005 Dunaway ..... 53/452
2002/0036228 A1 * 3/2002 Reese et al. ..... 229/4.5
2002/0190109 A1 12/2002 Mrgan
2002/0190111 A1 * 12/2002 Boatwright et al. .... 229/125.05
2003/0005617 A1 1/2003 Holverson, Jr.
2003/0038170 A1 * 2/2003 Case ..... 229/125.05
2004/0226990 A1 * 11/2004 Williams et al. ..... 229/123.1
2005/0167430 A1 8/2005 Varadarajan
2005/0279814 A1 * 12/2005 Drummond ..... 229/5.84

FOREIGN PATENT DOCUMENTS

DE 1761758 B * 1/1978
EP 1 002 731 5/2000
NL 279091 5/1962

* cited by examiner

*Primary Examiner*—Nathan J Newhouse
*Assistant Examiner*—Christopher Demeree
(74) *Attorney, Agent, or Firm*—Alston & Bird LLP

(57) ABSTRACT

A container having an integrated bottom end closure subassembly. The container includes a top opening and bottom opening. The top opening is initially closed and sealed with a top membrane while the bottom opening is closed by the end closure subassembly. The subassembly includes an end cap and a bottom membrane. The subassembly is configured so that positioning the end cap onto the container to close the bottom opening positions the bottom membrane near the container. The bottom membrane may be sealed to the container. Once the bottom membrane is sealed to the container, the end cap may be removed from the container independently from the bottom membrane. The end cap provides protection to the bottom membrane during shipping and handling and then is used by the consumer to reclose the top opening once the top membrane is removed.

10 Claims, 2 Drawing Sheets

COMPOSITE CONTAINERS AND METHODS FOR SEALING THE SAME

BACKGROUND OF THE INVENTION

Figure 1:
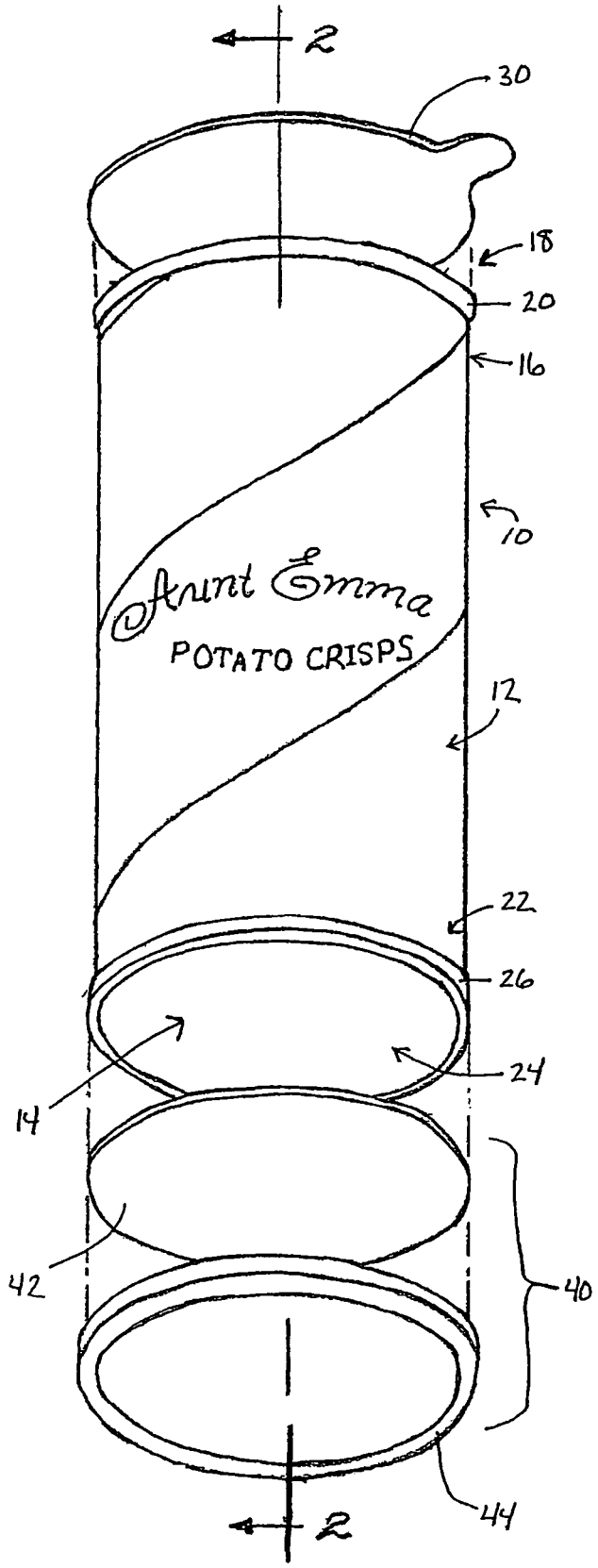

The present invention relates generally to composite containers with end caps and removable membranes and methods of sealing such containers.

Conventional containers for snack foods and other products often have a membrane sealed to a top rim of the container and a post-applied overcap or end cap covering the membrane, and a metal closure seamed onto a bottom rim of the container. Typically, the container manufacturer will seal the membrane to the top rim, apply the end cap to the container, and ship the container to a food packager. The food packager fills the container with the products through the open bottom of the container and then seams the metal closure to the bottom rim of the container. The container may be flushed or evacuated during the bottom seaming process in order to preserve the stored products for a longer period of time.

The sealed membrane provides a hermetic seal for protecting the products. The sealed membrane is removed by the customer when the container is first opened, and the membrane is discarded. The end cap is provided for re-closing the container after the initial opening. Typically, the end cap engages the rim (e.g., a rolled bead or a flange) on the top of the container in such a way that a snap-fit or interference fit connection exists to hold the end cap onto the container.

The metal closure seamed to the bottom rim also provides a hermetic seal for protecting the products. However, unlike the membrane sealed to the top rim, the bottom metal closure is not intended to be removable. Therefore the bottom seal is generally stronger than the top seal. Moreover, the bottom end of the container, including the bottom closure and the bottom seal, must be durable enough to withstand the rigors of shipping and handling.

Although a metal closure provides adequate protection, metal is an expensive material to use in a disposable container. Therefore there remains a need to provide a low-cost bottom closure for a container that can adequately protect the container and its contents during shipping and handling.

BRIEF SUMMARY OF THE INVENTION

The present invention seeks to address some of the needs stated above by providing a container for storing products. The container includes a top opening and bottom opening. The top opening is initially closed and sealed with a top membrane while the bottom opening is closed and sealed by an end cap and a bottom membrane. The bottom membrane may be pre-inserted into the end cap such that positioning the end cap onto the container to close the bottom opening also positions the bottom membrane near or against the container. From this position the bottom membrane may be sealed to the container. Once the bottom membrane is sealed to the container, the end cap may be removed from the container independently from the bottom membrane. Therefore, the end cap may be used to provide protection to the bottom membrane and the bottom end of the container during shipping and handling and then be used by the consumer to reclose the top opening once the top membrane is removed to initially open the container to gain access to its contents.

According to one embodiment of the present invention, the container includes a body, a top membrane, and an end closure subassembly. The body may be tubular and include a top end and a bottom end. The body also defines an interior for storing one or more products. The top end defines the top opening and the bottom end defines a bottom opening. The top membrane is sealed to the top end for closing the top opening and defining a top seam between the top membrane and the top end of the container. The top membrane is configured to be removable from the top opening substantially along the top seam. The end closure subassembly includes a bottom membrane and an end cap. The subassembly is held onto the bottom end of the container such that the bottom membrane is between the end cap and the bottom end of the container and the bottom membrane is sealed to the bottom end for sealing the bottom opening. The end cap is removable from the bottom end of the container independently from the bottom membrane and is configured to be engageable with either the top end or the bottom end of the container.

A seam is defined between the bottom membrane and the bottom end. This seam may have a peel strength greater than the ultimate strength of the bottom membrane, which inhibits the removal of the bottom membrane from the container along the seam. The bottom membrane may be substantially of the same material or construction as the top membrane.

The present invention also provides a method of sealing the container. The method includes sealing the top opening with the top membrane and then depositing the product or products into the interior of the container through the bottom opening. Next, the bottom opening is closed with the bottom membrane and the end cap. The bottom membrane and the end cap may engage the bottom end of the container together or separately. The bottom membrane is sealed to the bottom end, which allows the end cap to be removed from the bottom end independently from the bottom membrane.

Among the many features of the present invention, the end cap provides additional protection to the bottom end of the container during shipping and handling of the container. This additional protection allows the bottom membrane to be a weaker material than the metal closures typically found on such containers. Furthermore, the end cap may be used to reclose the top opening once the top membrane is removed by the consumer. Also, according to one embodiment of the present invention, the integrated subassembly allows the bottom membrane and end cap to be added in one step.

BRIEF DESCRIPTION OF THE SEVERAL VIEWS OF THE DRAWING(S)

Figure 2:
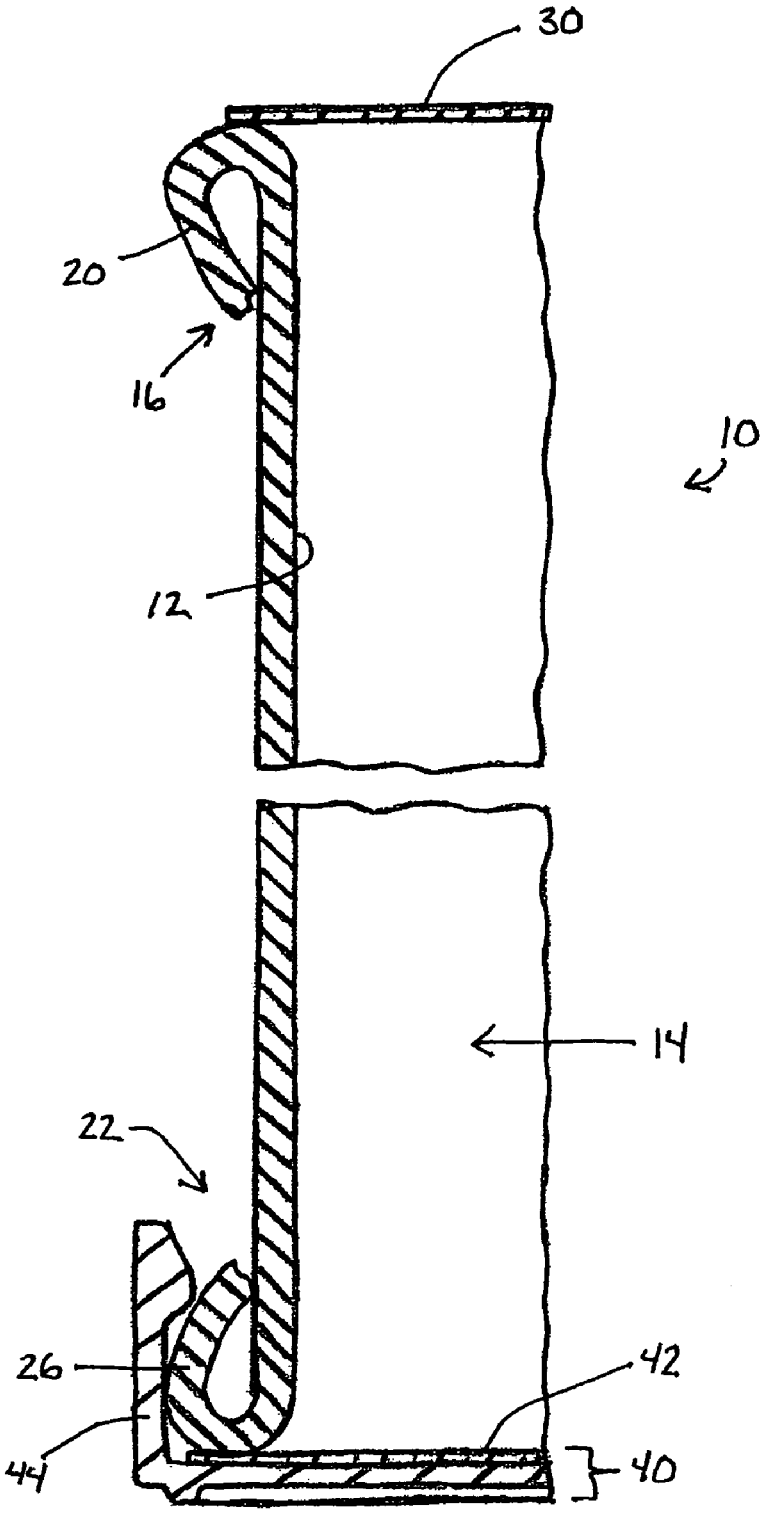

Having thus described the invention in general terms, reference will now be made to the accompanying drawings, which are not necessarily drawn to scale, and wherein:

FIG. 1 is a perspective view of a container constructed according to an embodiment of the present invention and wherein the components of the container including the end closure subassembly are exploded; and FIG. 2 is a sectional view in a non-exploded form and taken generally along the line 2-2 of FIG. 1.

DETAILED DESCRIPTION OF THE INVENTION

The present invention now will be described more fully hereinafter with reference to the accompanying drawings in which some but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

As shown in the FIGS. 1-2, the present invention provides a container 10 for storing one or more products. The container 10 includes a body 12, a top membrane 30, and a bottom membrane 42 and an end cap 44.

The body 12 defines an interior 14 for storing the products and has a top end 16 and a bottom end 22. The top end 16 defines a top opening 18 and the bottom end 22 defines a bottom opening 24. According to the illustrated embodiment, the body is tubular, which is particularly beneficial for packaging food products such as potato crisps or peanuts. Although illustrated as having a circular cross sectional shape, the cross sectional shape of the container may vary. For example, the container may have a generally rectangular cross-section with rounded corners.

The body may include at least one structural body ply and be formed by wrapping a continuous strip of body ply material, such as paperboard, around a mandrel of a desired shape to create the body structure. The body ply strip may be spirally wound around the mandrel or passed through a series of forming elements so as to be wrapped in a convolute shape around the mandrel. At the downstream end of the mandrel, the body structure may be cut into discrete container bodies.

The body may also include an innermost liner ply. The liner ply may be supported or unsupported as described in U.S. Pat. No. 6,270,004, which is assigned to the assignee of the present invention and is herein incorporated by reference. In general, the liner prevents liquids from leaking out of the container and prevents liquids from entering the container and contaminating or degrading the products contained within the interior of the container. The liner may also be resistant to the passage of gases, so as to prevent odors of the products in the container from escaping or preventing atmospheric air and/or water vapor from entering the container and possibly spoiling the products. The liner ply may have multiple layers including polymeric layers and barrier layers as described in U.S. Patent Application Publication No. 2003/0038170, which is assigned to the assignee of the present invention and is herein incorporated by reference.

As shown in the figures, the top end 16 and the bottom end 22 may be rolled outwardly to form a rim 20, 26. As explained further below, each rim may provide a surface for attaching or engaging the top membrane 30, the bottom membrane 42, or the end cap 44 to the container 10.

For example, the top membrane 30 may be attached substantially along the top rim 20 in order to close and seal the top opening 18. More specifically, the top membrane may include a heat-sealable surface or portion for heat sealing the top membrane to the top rim or an adhesive may be applied for sealing the top membrane to the top rim. The top membrane, also referred to as a flexible end closure, may be of a flexible laminate made of films, kraft paper, foil, and/or extruded polymers. The top membrane may further include a barrier layer that serves as a barrier to the passage of liquids and/or gasses such as oxygen as described in U.S. Patent Application Publication No. 2003/0038170.

The top membrane is configured to be removable from the container. For example, as described above, the attachment of the top membrane to the top rim may define a seam between the top membrane and the container. The peel strength of the seam is weaker than the ultimate strength of the top membrane. Therefore, after sealing the top membrane to the container, the top membrane may be peeled from the container substantially along the seam.

The end cap 44, also referred to as an overcap, includes a top panel and a skirt. The top panel is generally shaped and sized such that it can cover the top opening or the bottom opening of the container. The top panel may include additional features on the top surface and the bottom surface of the top panel. The skirt extends from an outer periphery of the top panel. The skirt may have one or more ribs projecting inwardly from the skirt as described in U.S. Patent Application Publication No. 2005/0167430, which is assigned to the assignee of the present invention and is herein incorporated by reference. The ribs and skirt are configured to engage either the top end or bottom end of the container. For example, the skirt may be sized to cause an interference fit between either the top rim or the bottom rim such that the end cap can be held onto the container by either rim.

The end cap may be made of various materials that have sufficient flexibility and resilience to allow the necessary deformation of the end cap as it is pushed onto the container. Suitable materials include but are not limited to polyester, polyolefins (including homopolymers, co-polymers, etc.) such as polyethylene or polypropylene, polystyrene, elastomers (including thermo-plastic rubber, thermoplastic elastomer, etc,), and mixtures or combinations thereof. An end cap of a more rigid material may include a thin-wall portion in the top panel or skirt such that the rigid material is allowed to flex.

According to an embodiment of the present invention, the bottom membrane may be connected to or pre-inserted into the end cap forming an integrated end closure subassembly 40. For example, the bottom membrane may be adhered to the top panel such that the membrane is substantially within the top panel and the skirt, or the bottom membrane may engage the rib in the skirt such that the bottom membrane is held within the skirt. The bottom membrane may be substantially the same size or the same construction as the top membrane. Alternatively, the two membranes may differ. For example, the bottom membrane may be larger to accommodate the connection with the end cap.

The end closure subassembly engages the bottom end of the container such that the skirt of the end cap is around the bottom end, and the bottom membrane is between the top panel and the bottom rim and bottom opening. More specifically, the height of the skirt may be configured such that the top panel urges the bottom membrane against the rim. The bottom membrane is sealed to the bottom end. For example, the bottom membrane may be heat-sealed to the bottom rim and/or an adhesive may be used. The bottom membrane may be heat-sealed by ultrasonic welding, RF welding, induction welding or other heat-sealing processes.

The sealing of the bottom membrane to the bottom end of the container creates a seam between the container and the bottom membrane. Unlike the top membrane, the bottom membrane may be configured not to be removable from the container. The peel strength of the seam between the bottom membrane and the container may be greater than the ultimate strength of the bottom membrane. Therefore the strength of the seam inhibits the removal of the bottom membrane such that an attempt to remove the bottom membrane may likely result in the tearing of the bottom membrane.

Once sealed, the end cap may be removed from the bottom end of the container independently from the bottom membrane. Specifically, the seam between the bottom membrane and the container is strong enough to overcome any connection between the end cap and the bottom membrane such that removing the end cap separates the bottom membrane from the end cap. As described herein the end cap is also configured to engage the top end of the container. Therefore, after removing the top membrane from the top end, the end cap may be used to reclose the top opening.

According to another embodiment of the present invention, the bottom membrane may be attached or sealed to the bottom end of the container prior to the introduction of the end cap. Once the bottom membrane is attached or sealed to the bottom end, the end cap engages the bottom end of the container such that the bottom membrane is between the end cap and the container.

Another aspect of the present invention is a method of sealing and packaging the container. First, the top membrane is sealed to the container to close the top opening as described above. The product or products are placed into the interior of the container through the bottom opening. Once the products are placed into the interior, the end closure subassembly closes the bottom opening, including sealing the bottom membrane to the bottom end of the container. This step may also include flushing or evacuating the interior of the container, in order to better preserve the products.

During shipping and handling, the end closure subassembly provides a sealed closure for the bottom end of the container with the end cap providing protection to the bottom end including the bottom seal from potential impact and other forces associated with shipping and handling. Once the end user removes the top membrane to obtain access to the interior, the end cap may be moved from the bottom end to the top end in order to reclose the top opening.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A container for storing products, the container comprising:

a tubular body extending from a top end to a bottom end and defining an interior space for storing products, the top end defining a top opening and the bottom end defining a bottom opening and wherein the top end is rolled outwardly to form a top rim and the bottom end is rolled outwardly to form a bottom rim;

a top membrane sealed to the top rim for closing the top opening and defining a top seam between the top membrane and the top end, wherein the top membrane is configured to be removable from the top opening substantially along the top seam;

a bottom membrane sealed to the bottom rim for closing the bottom opening and defining a bottom seam between the bottom membrane and the bottom end, the bottom seam having a peel strength greater than an ultimate strength of the bottom membrane, thereby inhibiting removal of the bottom membrane along the bottom seam from the container; and an end cap having a panel and a skirt, the skirt extends along an outer periphery of the panel and is configured to engage the bottom end of the container such that the bottom membrane is between the body and the panel;

wherein the interior space extends in a continuous fashion from the bottom opening to the top opening of the tubular body such that any products in the interior space are removable through the top opening after removal of the top membrane;

wherein the end cap is removable from the bottom end of the container and is configured to cause an interference fit between either the top rim or the bottom rim such that the end cap is configured to be held onto the container by either the top rim or the bottom rim including to reclose the top opening after removal of the top membrane.

2. A method of sealing a container for storing one or more products, said method comprising the steps of:

providing a tubular container extending from a top end to a bottom end and defining an interior space for storing products, the top end defining a top opening and the bottom end defining a bottom opening, wherein the interior space extends in a continuous fashion from the bottom opening to the top opening such that any products in the interior space are removable through the top opening;

sealing a top membrane to the top end of the container such that the top membrane closes the top opening and such that the top membrane is peelable from the top end for opening the container;

depositing one or more products into the interior space of the container through the bottom opening;

connecting a bottom membrane to an end cap, the end cap having a central portion and a skirt;

closing the bottom opening with the bottom membrane by engaging the end cap with the bottom end of the container such that the bottom membrane is between the central portion of the end cap and the container; and affixing the bottom membrane to the bottom end of the container such that the end cap is removable from the container independently from the bottom membrane;

wherein the affixing of the bottom membrane to the bottom end forms a seam between the bottom membrane and the bottom end, the seam having a peel strength greater than an ultimate strength of the bottom membrane, thereby inhibiting removal of the bottom membrane along the seam from the container.

3. The method according to claim 2, wherein the bottom membrane is affixed to the container by a heat seal.

4. The method according to claim 2, wherein the bottom membrane is affixed to the container by an adhesive.

5. The method according to claim 2 further comprising removing the top membrane from the container; removing the end cap from the bottom membrane and the bottom opening of the container; and closing the top opening by engaging the end cap to the container such that the end cap substantially covers the top opening.

6. The method according to claim 2 further comprising flushing the interior before sealing the bottom membrane to the container.

7. A method of packaging and handling a composite container of one or more products, the method comprising:

providing a tubular body wherein the body defines an interior space for storing products and includes a top end and a bottom end, and the top end defines a top opening and the bottom end defines a bottom opening, wherein the interior space extends in a continuous fashion from the bottom opening to the top opening such that any products in the interior space are removable through the top opening;

sealing a flexible top membrane to the top end so as to close the top opening with the top membrane and such that the top membrane is peelable from the top end for opening the container;

depositing the one or more products into the interior space through the bottom opening;

engaging an end cap having an attached bottom membrane with the bottom end of the container so as to close the bottom opening and position the bottom membrane between the end cap and the bottom end of the container; and sealing the bottom membrane to the bottom end;

wherein the sealing of the bottom membrane to the bottom end forms a seam between the bottom membrane and the bottom end, the seam having a peel strength greater than an ultimate strength of the bottom membrane, thereby inhibiting removal of the bottom membrane along the seam from the container.

8. The method according to claim 7, further comprising removing the top membrane from the top end of the container for gaining access to the interior; removing the end cap independently from the bottom membrane; and closing the top opening with the end cap.

9. A method of packaging and handling a composite container of one or more products, the method comprising:

providing a container having a body that extends from a top end to a bottom end and defines an interior space, wherein the top end defines a top opening and the bottom end defines a bottom opening, wherein the interior space extends in a continuous fashion from the bottom opening to the top opening such that any products in the container are removable through the top opening;

rolling outwardly the top end to form a top rim;

rolling outwardly the bottom end to form a bottom rim;

sealing a top membrane to the top rim so as to close the top opening with the top membrane and such that the top membrane is peelable from the top rim for opening the container;

depositing the one or more products into the interior of the container through the bottom opening;

sealing a bottom membrane to the bottom rim so as to close the bottom opening with the bottom membrane; and engaging an end cap with the bottom end such that the end cap is held onto the bottom end through an interference fit and the bottom membrane is between the container and the end cap, wherein the end cap is removable from the bottom end of the container and is configured to be engaged with the top end of the container by causing an interference fit with the top end to reclose the top opening after removal of the top membrane;

wherein the sealing of the bottom membrane to the bottom rim forms a seam between the bottom membrane and the bottom rim, the seam having a peel strength greater than an ultimate strength of the bottom membrane, thereby inhibiting removal of the bottom membrane along the seam from the container.

10. A container for products, comprising:

a tubular body defining an interior space for storing products, the tubular body having a top end defining a top opening into the interior space and having an opposite bottom end defining a bottom opening into the interior space;

a flexible top membrane affixed to the top end by a top membrane bond so as to close the top opening, the top membrane bond having a peel strength weaker than an ultimate strength of the top membrane;

a flexible bottom membrane affixed to the bottom end by a bottom membrane bond so as to close the bottom opening, the bottom membrane bond having a peel strength greater than an ultimate strength of the bottom membrane; and an end cap configured to be engaged with either the top end or the bottom end of the tubular body and to be removable from the bottom end while the bottom membrane remains sealed to the bottom end;

wherein the top membrane bond is such as to allow the top membrane to be peeled off the top end to gain access to products in the interior space, while the bottom membrane bond inhibits removal of the bottom membrane from the bottom end.

* * * * *